US008790004B2

(12) United States Patent
Chatelain

(10) Patent No.: US 8,790,004 B2
(45) Date of Patent: Jul. 29, 2014

(54) DEVICE FOR ATTACHING AN INTERCHANGEABLE BRACELET FOR A TIMEPIECE

(71) Applicant: Société anonyme de la Manufacture d'horlogerie Audemars Piguet & Cie, Le Brassus (CH)

(72) Inventor: Christophe Chatelain, Labergement Sainte Marie (FR)

(73) Assignee: Societe Anonyme de la Manufacture d'Horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 13/871,587

(22) Filed: Apr. 26, 2013

(65) Prior Publication Data

US 2013/0286796 A1 Oct. 31, 2013

(30) Foreign Application Priority Data

Apr. 27, 2012 (CH) ..... 0578/12

(51) Int. Cl.
*G04B 37/00* (2006.01)

(52) U.S. Cl.
USPC ..... 368/282

(58) Field of Classification Search
USPC ..... 368/281–283; 224/164–180, 265 B, 224/265 R, 267, 264 WS
See application file for complete search history.

(56) References Cited

U.S. PATENT DOCUMENTS

| | | | | |
|---|---|---|---|---|
| 5,416,953 | A | 5/1995 | Hui | |
| 5,914,913 | A | 6/1999 | Shriqui | |
| 5,943,302 | A * | 8/1999 | Fanshaw | 368/276 |
| 7,070,322 | B1 * | 7/2006 | Field et al. | 368/281 |
| 7,575,368 | B2 * | 8/2009 | Guillaume | 368/282 |
| 8,235,585 | B2 | 8/2012 | Speichinger | |
| 2013/0003510 | A1 | 1/2013 | Speichinger | |

FOREIGN PATENT DOCUMENTS

| | | | |
|---|---|---|---|
| CH | 73121 | A | 8/1916 |
| CH | 179155 | A | 8/1935 |
| CH | 664663 | A | 3/1988 |
| EP | 0164166 | A1 | 12/1985 |
| EP | 0640894 | A1 | 3/1995 |
| EP | 0682300 | A1 | 11/1995 |

(Continued)

OTHER PUBLICATIONS

Search Report dated Aug. 16, 2012 for Swiss Application No. CH00578/12 filed Apr. 27, 2012, 3 pages.

*Primary Examiner* — Edwin A. Leon
(74) *Attorney, Agent, or Firm* — Patterson Thuente Pedersen, P.A.

(57) ABSTRACT

A device for the rapid attachment of an interchangeable watch bracelet for wrist watches, as well as a wrist watch and an interchangeable watch bracelet. A body used as a push button slidingly housed in a watch case includes a retaining stem arranged parallel to the watch case. The body is displaceable parallel to a longitudinal axis of the retaining stem and the body is biased in a rest position. The device includes an attachment element mounted at one end of the interchangeable watch bracelet, comprising a slot with a shape complementary to that of the retaining stem. The retaining stem is thus adapted, depending on its position along the longitudinal axis, to cooperate with the attachment element or elements so as to enable the interchangeable watch bracelet to be attached to or to be removed from the watch case.

15 Claims, 4 Drawing Sheets

(56) References Cited

FOREIGN PATENT DOCUMENTS

| | | | |
|---|---|---|---|
| EP | 0797132 | A1 | 9/1997 |
| EP | 0862097 | A1 | 9/1998 |
| EP | 1400875 | A1 | 3/2004 |
| GB | 2264628 | A | 9/1993 |
| JP | H0174813 | U | 5/1989 |
| JP | 2006296544 | A | 11/2006 |
| WO | WO 2005/029204 | A1 | 3/2005 |

* cited by examiner

DEVICE FOR ATTACHING AN INTERCHANGEABLE BRACELET FOR A TIMEPIECE

RELATED APPLICATION

The present application claims priority to Swiss Application No. CH 00578/12 filed Apr. 27, 2012, which is incorporated herein in its entirety by reference.

TECHNICAL FIELD

The present invention relates to devices for the rapid attachment of an interchangeable watch bracelet for wrist watches. In particular, it relates to devices having a body used as a push button and adapted to be slidingly housed in a watch case, the body bearing a retaining stem arranged parallel to the plane of the watch case and in the direction of sliding of the body, so that the body is displaceable parallel to a longitudinal axis of the retaining stem.

BACKGROUND ART

This type of device is known in principle; it has even existed for many years in a large number of devices enabling a watch bracelet to be detachably fixed onto a wrist watch. However, most of these devices are too difficult in design, require a tool to change the bracelet, risk an inadvertent detachment of the bracelet, cannot be integrated easily or on an industrial scale in existing watch cases, or have other disadvantages, such as simply being not very attractive in appearance, a characteristic that is still rather important in this field.

For example, document U.S. Pat. No. 5,914,913 discloses an interchangeable bracelet system using a pair of pins housed in two hinges positioned laterally on the watch case that can be pulled by corresponding buttons so as to be able to remove them from a corresponding housing arranged on a connection element of the end of the bracelet, this connection element being adapted to be inserted between the hinges. This system is rather difficult to integrate in most watch cases found on the market, since they require two buttons that have to be pulled towards the exterior as well as being, for the same reason, difficult to use and aesthetically unattractive.

Similar comments apply to the device proposed in European patent application EP 1 400 875. In a particular way, this device realizes a system operating in the inverse manner as compared to the device described in document U.S. Pat. No. 5,914,913, by having a pair of pins housed in a single hinge positioned laterally on the watch case, these pins being adapted to be disengaged from the interchangeable bracelet embracing this hinge and receiving the pins in corresponding housings by pushing the buttons that act on the pins inside the hinge, thus enabling disengagement of the bracelet. Being probably more suitable for use than the device described in document U.S. Pat. No. 5,914,913, this system nevertheless does not overcome the other disadvantages mentioned above and, in addition, risks being inadvertently activated by the user of the watch, since the buttons are operated by pressure instead of traction.

The Swiss patent application CH 664 663 relates to a bracelet clasp having two push buttons arranged on both sides of the clasp and each extended by a variable diameter pin, able to cooperate with two horns attached to the watch case and equipped with a slot enabling the pin to slide into the horns when the push buttons are pushed, while the pins are blocked in the tips when the push buttons are released. As with the device according to document EP 1 400 875, this system is based on the principle of two exterior buttons activated by pressure and therefore has the same overriding disadvantage, i.e. a high risk of losing the bracelet by accidentally activating the push buttons. Simultaneously, this system does not overcome the other above mentioned disadvantages and, in particular, does not improve the aesthetics since it adds an additional piece of considerable size in the form of the clasp.

Document CH 179 155 discloses two embodiments of a device to fix an interchangeable bracelet. The first embodiment uses a push button mounted vertically with respect to the plane of the watch case enabling an end of a corresponding interchangeable bracelet to be blocked or released, this end being present in the form of a large tongue of a particular shape. The second embodiment uses a locking pin mounted rotatably in the watch case and cooperating with tongues which are also of a particular shape and arranged on the end of the bracelet. Whereas the two devices proposed require specific bracelets with, in particular, the tongues of a specific shape, thus not allowing most bracelets on the market to be used, the second device proposed moreover requires the use of a tool such as a screwdriver to rotate the locking pin by 90° in order to allow the bracelet to be removed from or attached to the watch, which makes the use of such an interchangeable bracelet rather inconvenient.

Documents JP 2006/296544, U.S. Pat. No. 5,416,953, GB 2 264 628, JPH 0 174 813, and CH 73 121 disclose still other devices of this type, without the systems proposed necessarily being able to overcome all the above mentioned disadvantages. The solutions currently known from the prior art therefore cannot be considered satisfactory with respect to all aspects cited above.

Thus, a need still exists to have a device for the rapid attachment of an interchangeable watch bracelet of the above mentioned type, the design of which is relatively simple, whose operation is sure without its utilization necessarily being tedious or even requiring a tool, and which may be used with a large number of existing watch cases as well as bracelets on the market. In addition, it is desirable and important that these objectives are achieved while guaranteeing moderate production costs as well as offering an attractive aesthetic for the watches integrating this device.

SUMMARY OF THE INVENTION

The object of the present invention is therefore to remedy the disadvantages of known devices and to achieve the above-mentioned advantages, notably enabling the production of a device for the rapid attachment of an interchangeable watch bracelet that is simple in its design and use, reliable during its operation, as well as compact, sturdy and aesthetic, while reducing the production costs of the device and increasing the compatibility of the device with existing watch cases and bracelets.

For this purpose, embodiments of the present invention propose a device for the rapid attachment of an interchangeable watch bracelet for wrist watches of the above mentioned type, the device being distinguished by the characteristics stated in claim 1, as well as a corresponding wrist watch and interchangeable watch bracelet comprising such a device. In particular, in the device according to embodiments of the present invention, the body cooperates with a spring arranged substantially parallel to the retaining stem and exerting a pretension force biasing the body used as a push button in a rest position, the retaining stem has a particular shape having in at least one predefined location along its longitudinal axis a reduced thickness with relation to a reference thickness that presents the rest of the retaining stem, and the device comprises at least one attachment element adapted to be mounted at one end of the interchangeable watch bracelet and comprising a slot with a shape complementary to that of the retaining stem, this latter being adapted, depending on its position along said longitudinal axis, to cooperate with the attachment element or elements so as to allow the interchangeable watch bracelet to be attached to or removed from the watch case.

In an embodiment of the device according to the present invention, the retaining stem comprises guiding flats in at least one predefined location, preferably in two predefined locations, such that the guiding flats are aligned with the slots of said attachment elements when the body used as a push button is activated and such that the guiding flats are at least partially offset from these slots when the body used as a push button is in its rest position.

By these measures, due to the fact that only a single push button is used, a device that is simple to use and that also has a particularly simple design is obtained. The small size of the device allows it to be integrated in a large number of existing watch cases by providing the machining of a corresponding housing. Furthermore, the presence of attachment elements enables the device to be combined with many pre-existing bracelets without significant modifications to the latter.

The body used as a push button is, preferably, arranged so as to present, in the rest position, an external surface that is aligned and homogeneous with respect to the external surface of the watch case in which it is supposed to be integrated, which leads to a particularly sure and reliable operation of this type of device, given that an inadvertent activation can be practically ruled out. Simultaneously, this construction leads to a particularly advantageous aesthetic of a wrist watch integrating such a device, the push button hardly being visible on the watch case.

Embodiments of the present invention also relate to a corresponding watch case and interchangeable watch bracelet.

Other characteristics, as well as the corresponding advantages, will emerge from the dependent claims, as well as from the description exposing here below the invention in further detail.

The attached drawings schematically represent, by way of example, an embodiment of the invention.

DETAILED DESCRIPTION

The invention will now be described in detail with reference to the attached drawings illustrating, by way of example, an embodiment of the invention.

Figure 1A:
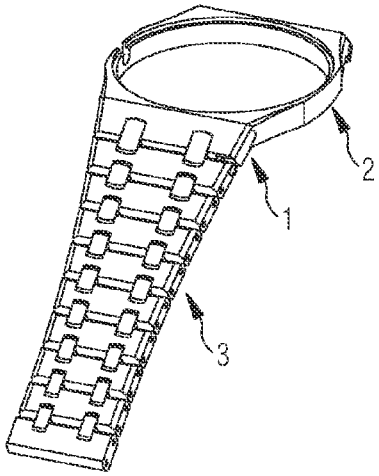
FIG. 1*a* is a schematic perspective view of an interchangeable bracelet mounted on a watch case by using a rapid attachment device according to the present invention.
Figure 1B:
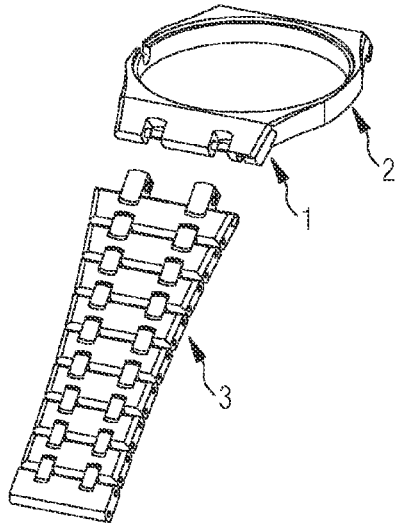
FIG. 1*b* is a perspective view similar to FIG. 1*a*, the interchangeable bracelet being disassembled from the watch case.

A rapid attachment device 1 of an interchangeable watch bracelet 3 according to an embodiment of the present invention is supposed to be integrated in a timepiece, particularly in a wrist watch 2. As schematically illustrated by way of example in the perspective views of FIGS. 1*a* and 1*b* illustrating an interchangeable bracelet 3 mounted on a watch case 2 by using a rapid attachment device 1 according to an embodiment of the present invention, respectively the same bracelet in its state disassembled from the watch case, this rapid attachment device 1 enables a bracelet 3 to be attached to and to be detached from a watch case 2, while the difference between an interchangeable bracelet 3 and a conventional bracelet is practically not noticeable for the user, in view of the aesthetics of a watch equipped with this device.

Figure 1C:
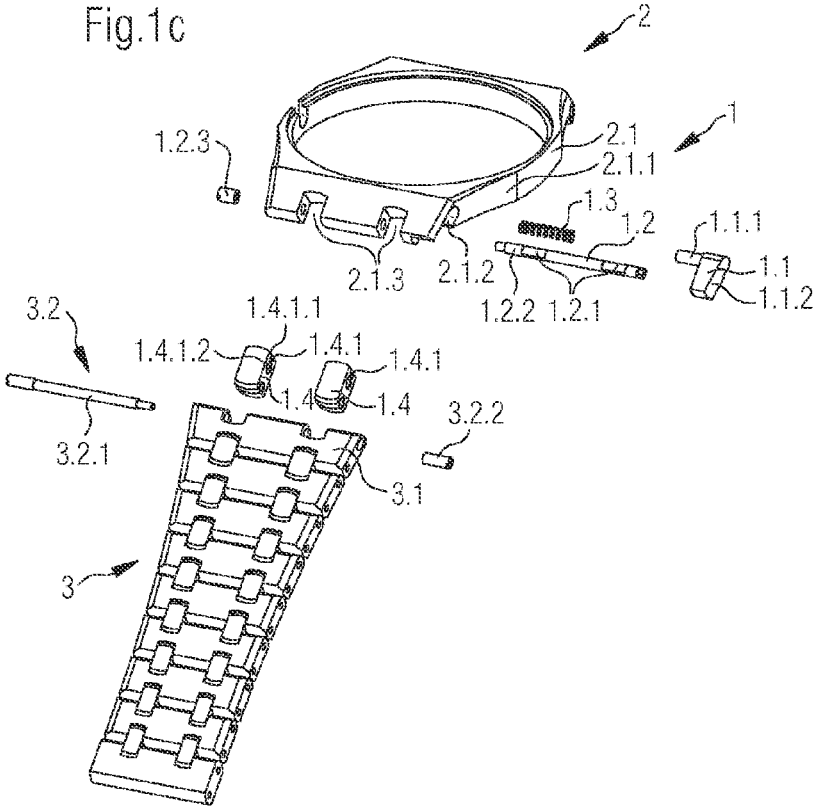
FIG. 1*c*, depicts, in exploded view, a rapid attachment device according to the present invention as well as a corresponding watch case and interchangeable watch bracelet.

FIG. 1*c*, depicting an exploded perspective view of such a rapid attachment device 1 according to an embodiment of the present invention as well as of a corresponding watch case 2 and of an interchangeable watch bracelet 3, enables the main components of the device to be seen clearly. As the watch itself is not important regarding the present invention and may be of any type, of mechanical or electronic movement and analogue or digital display, it is only represented in the figures by the watch case 2. The attachment device 1 comprises a body 1.1 that is used as a push button and that is able to be housed slidingly in watch case 2 of the corresponding wrist watch, the movement along an axis parallel to the spring bar usually situated on conventional watch cases. This body 1.1 bears a retaining stem 1.2 arranged, in the state assembled with the watch case 2, parallel to the plane of the watch case 2 and in the sliding direction of said body 1.1. Therefore, the body 1.1 and the retaining stem are displaceable parallel to a longitudinal axis of said retaining stem 1.2, the latter replacing the usual spring bar in a particular way.

Figure 1D:
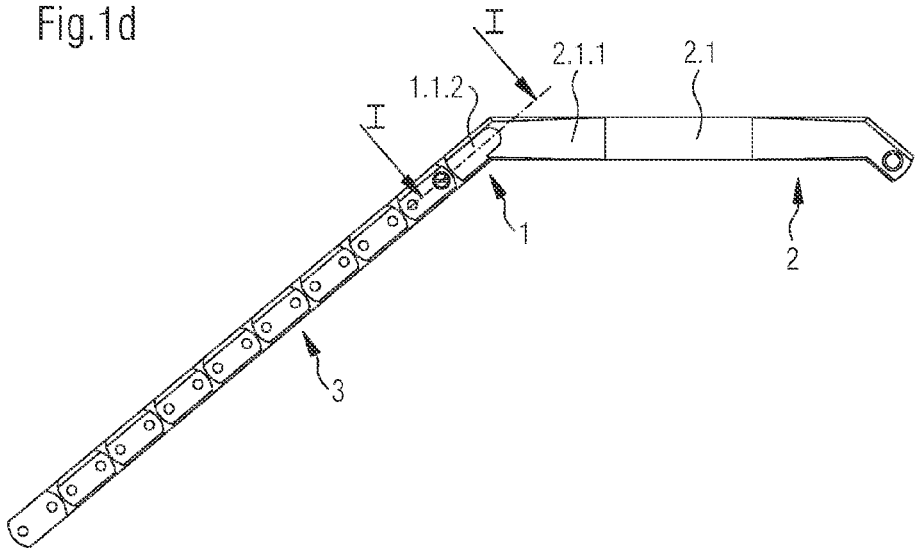
FIG. 1*d* is a side view of the interchangeable bracelet from FIG. 1*a*, attached to a watch by using the device according to the invention.
Figure 1E:
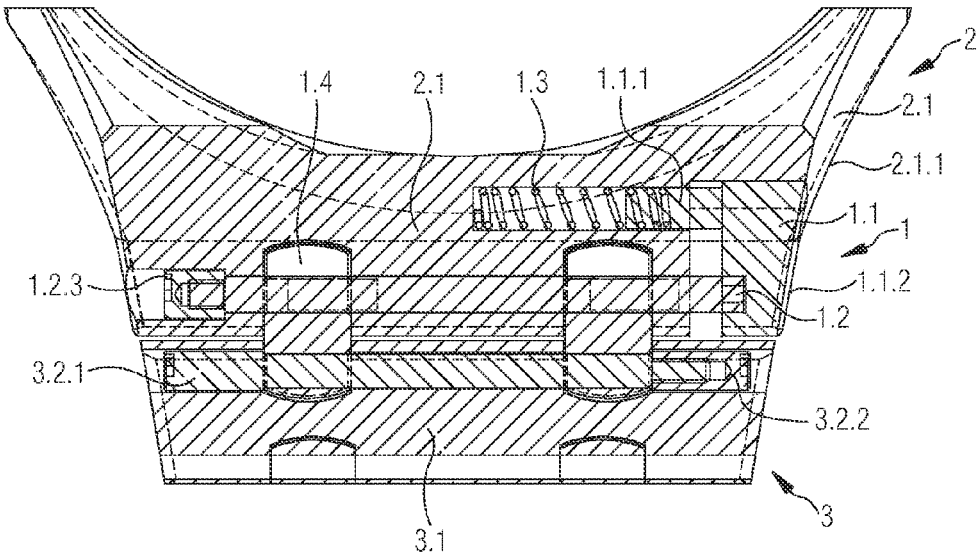
FIG. 1*e* depicts a sectional view along line I-I indicated in FIG. 1*d* across the rapid attachment device according to an embodiment of the present invention, respectively the corresponding watch case and interchangeable watch bracelet, the device being in the rest position.

In addition, body 1.1 cooperates with a spring 1.3 arranged substantially parallel to the retaining stem 1.2 and exerting a pretension force biasing body 1.1 used as a push button in a rest position. This is particularly visible in FIG. 1*e* showing a sectional view along line I-I indicated in FIG. 1*d* across the attachment device 1. FIG. 1*e* also shows that spring 1.3 may for example be fixed to a free end of a pin 1.1.1 mounted on body 1.1 used as a push button and arranged parallel to said retaining stem 1.2. Preferably, said spring 1.3 is a helical spring. In general, spring 1.3 is chosen such that the pretension force guarantees to prevent an inadvertent activation of body 1.1 used as a push button. FIGS. 1*a* and particularly 1*e* both illustrate that the body 1.1 used as a push button is arranged so as to present, in its rest position, an external surface 1.1.2 that is aligned and homogeneous with relation to the external surface 2.1.1 of the middle part 2.1 of the watch case 2 in which it is supposed to be integrated. Thus, the risk of inadvertent activation of body 1.1 may be reduced even more and this simultaneously gives a particularly advantageous aesthetic to the corresponding watch due to the fact that the push button is integrated in a perfectly discreet manner.

Figure 2A:
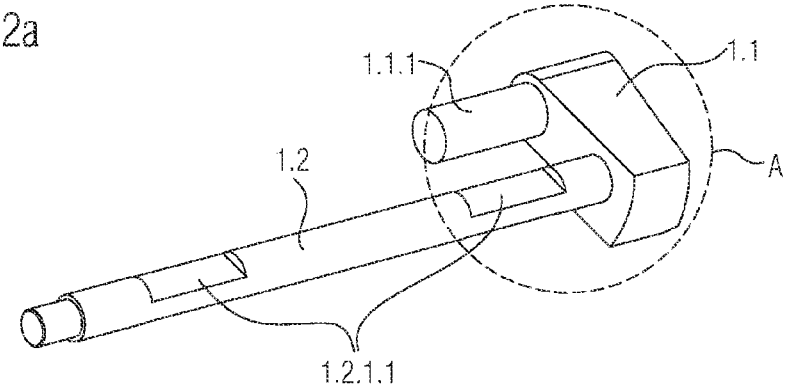
FIG. 2*a* represents a perspective view of an embodiment of the body used as a push button as well as of the retaining stem of a rapid attachment device according to the present invention.

Retaining stem 1.2 mounted on body 1.1 has a particular shape and is disposed in at least one predefined location along the longitudinal axis a reduced thickness 1.2.1 with respect to a reference thickness 1.2.2 that presents the rest of retaining stem 1.2. According to the preferred embodiment illustrated in the figures, and as seen in particular in FIGS. 2*a* and 2*c*, the retaining stem 1.2 is made by a stem of constant diameter and comprises guiding flats 1.2.1.1 with a length representing a fraction of the length of the stem 1.2 in at least one predefined location along its longitudinal axis, preferably in two predefined locations. It is particularly preferable to construct two guiding flats 1.2.1.1 situated on opposite sides that are parallel to each other at each of the predefined locations, as also emerges from FIG. 2*c* that shows an enlargement of zone A indicated in FIG. 2*a*, some parts being illustrated in transparency for better comprehension of the structure of the pieces. Over the entire length of the predefined locations and seen in a specific orientation, i.e. the direction perpendicular to the plane of the guiding flats 1.2.1.1, the retaining stem 1.2 thus presents a reduced thickness 1.2.1, while it presents the reference thickness 1.2.2 over the rest of its length, or a thickness situated between these two extreme values over the length of the predefined locations but measured in a direction other than the direction perpendicular to the plane of flats 1.2.1.1.

Figure 2B:
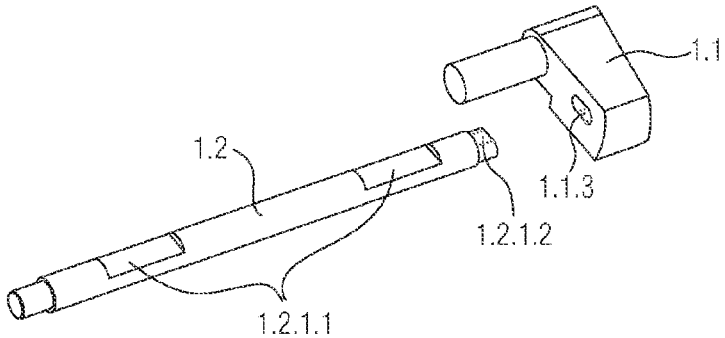
FIG. 2*b* depicts an exploded perspective view of the body and the retaining stem before their assembly.
Figure 2C:
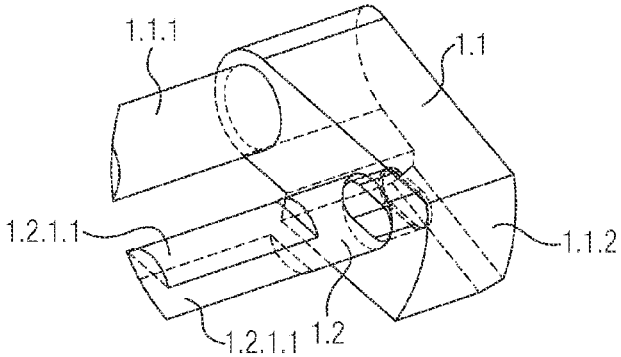
FIG. 2*c* depicts an enlargement of zone A indicated in FIG. 2*a*, some parts being illustrated in transparency for better comprehension.

As schematically illustrated in FIG. 2*b* showing an exploded perspective view of body 1.1 and retaining stem 1.2 before they are assembled, body 1.1 presents a blind hole adapted to receive an end of retaining stem 1.2, this blind hole having a first indexing flat 1.1.3 adapted to cooperate with a second indexing flat 1.2.1.2 situated on the end of pin 1.2, thus guaranteeing a precise orientation of the guiding flats 1.2.1.1 with relation to body 1.1 once these two pieces are assembled, respectively a precise orientation of the guiding flats 1.2.1.1 with relation to the watch case 2, for example with reference to the upper surface of this case 2 on its part accommodating the body 1.1, once the latter is introduced into the watch case 2. In addition, this assembly may be carried out by several methods, for example by soldering, brazing, gluing or any other suitable method. Producing body 1.1 and retaining stem 1.2 in a single piece is also possible.

The retaining stem 1.2 also comprises a terminal element 1.2.3, seen for example in FIG. 1*c* and in the sectional view of FIG. 1*e*. This terminal element 1.2.3 is assembled on the free end of retaining stem 1.2, opposite from its end fixed to body 1.1 used as a push button, and secures this body 1.1 against any detachment from the watch case 2. In fact, as seen in particular in FIG. 1*c*, the middle part 2.1 of a corresponding watch case 2 comprises, on each of its lateral opposed sides, a housing 2.1.2 adapted to receive body 1.1, retaining stem 1.2, and spring 1.3 of the attachment device 1. During the assembly of the rapid attachment device 1 and the corresponding watch case 2, body 1.1, retaining stem 1.2 and spring 1.3 are introduced into the housing 2.1.2 from its side supposed to receive body 1.1. Next, terminal element 1.2.3 is introduced into housing 2.1.2 from its opposite side and is fixed onto the free end of retaining stem 1.2, for example by being threadably received or by any other suitable means, so as to block body 1.1 in the housing 2.1.2 of the middle part 2.1 while enabling a movement in translation of body 1.1 following activation by the user. This configuration is best seen in FIG. 1*e*.

The exploded perspective view of FIG. 1*c* and the sectional view of FIG. 1*e* show that the attachment device 1 according to the present invention also comprises at least one attachment element 1.4 adapted to be mounted on one end 3.1 of an interchangeable watch bracelet 3. Such an attachment element 1.4 comprises a slot 1.4.1 of a shape complementary to that of the retaining stem 1.2, such that the latter 1.2 is adapted, depending on its position along the longitudinal axis, to cooperate with the attachment element or elements 1.4 in a manner allowing to fix or to remove said interchangeable watch bracelet 3 to or from the watch case 2.

Figure 2D:
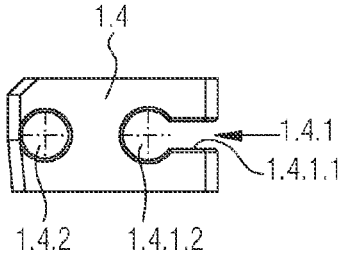
FIG. 2*d* is a longitudinal section across an attachment element of a rapid attachment device according to the present invention, illustrating, in particular, the specific shape of the slot of said element.

In particular and as seen notably in FIG. 2*d*, the slot 1.4.1 of complementary shape on each attachment element 1.4 is formed by a channel 1.4.1.1 with a height corresponding substantially to the reduced thickness 1.2.1 of the retaining stem 1.2. This channel 1.4.1.1 allows, in the activated position of said body 1.1 used as a push button, the retaining stem 1.2 to pass through and open to a through housing 1.4.1.2 with a diameter corresponding substantially to the reference thickness 1.2.2 of the retaining stem 1.2, this through housing 1.4.1.2 being adapted to receive the retaining stem 1.2 in the rest position of said body 1.1 used as a push button. In addition, each attachment element 1.4 is arranged so as to receive a fastening means 3.2 of a watch bracelet 3, for example by having a drilling 1.4.2 on the end of the attachment element 1.4 opposite to its end comprising the slot 1.4.1, enabling the fastening means 3.2 to be mounted on this end. The fastening means 3.2 may be constituted of a screwed bar 3.2.1, 3.2.2, a spring bar, a screw or any other suitable means. The attachment element 1.4 itself is, preferably and as illustrated in the figures, made of a substantially rectangular parallelepiped stud adapted to receive on its end, opposite from the end comprising slot 1.4.1, a screwed bar.

It remains to be pointed out, in view of the description figuring above of the preferred embodiment of the rapid attachment device 1 according to embodiments of the present invention, that other alternative embodiments of such a device are within reach of the person skilled in the art, without it being possible or even necessary to describe them in detail. For example, it is clear that spring 1.3 arranged substantially parallel to the retaining stem 1.2 may be fixed inside the watch case 2 and may act on the free end of pin 1.1.1 mounted on body 1.1 instead of being mounted on this pin 1.1.1 and acting on the watch case 2. In addition, body 1.1 may not comprise the pin 1.1.1, so that spring 1.3 is mounted directly on the retaining stem 1.2, even if this configuration is less preferable, since pin 1.1.1 enables, in addition to being used to assemble spring 1.3, the body 1.1 to be guided and stabilized during its movement in translation. In general, the shape of body 1.1 used as a push button may be adapted to the desired middle part both in its external shape and in the geometries enabling it to be displaced and guided.

In addition, retaining stem 1.2 may also be arranged differently. In fact, it is clear to the person skilled in the art that guiding flats 1.2.1.1 with a given length situated on at least one predefined location along the longitudinal axis of retaining stem 1.2, as described above, only form one possibility among several others of producing a predefined location along its longitudinal axis with a reduced thickness 1.2.1 with relation to a reference thickness 1.2.2 that presents the rest of the retaining stem 1.2. In other alternative embodiments, it would also be possible to produce these predefined locations along the longitudinal axis of pin 1.2 with a reduced thickness 1.2.1 by a stem part that is cylindrical but with a smaller diameter with relation to the diameter of the rest of retaining stem 1.2, by a stem part of square, hexagonal or other section as far as the thickness of this part of the retaining stem 1.2 is, at least in a specific orientation, less than the reference thickness of the rest of stem 1.2, all these variations not being illustrated in the figures. These explanations also further clarify that the design of two guiding flats 1.2.1.1 situated on opposite sides parallel to each other at each of the predefined locations on the retaining stem 1.2 is particularly preferable, because, besides the simplicity of production of such a stem, this also allows to define a specific orientation, i.e. the direction perpendicular to the plane of the guiding flats 1.2.1.1, that the normal on the plane of the slot 1.4.1 of attachment elements 1.4 should present to allow the interchangeable bracelet 3 to be removed from the rapid attachment device 1, even if the body 1.1 used as a push button is activated. Thus, this adds additional security against any inadvertent removal of bracelet 3. In addition, depending on the design of the interchangeable bracelet 3 and thus also on the desired number of attachment elements 1.4, the retaining stem 1.2 will be equipped at one, two, three or more predefined locations and on a suitable length along its longitudinal axis with these reduced thickness parts 1.2.1.

In addition, the attachment element 1.4 may take rather different shapes without the device departing from the domain of the present invention. In the case of an interchangeable bracelet 3 produced by parts hinged to each other in metal, and thus similar to a conventional metal bracelet, each attachment element 1.4 is, preferably, made of a substantially rectangular parallelepiped stud such as illustrated in the figures. In this case, the corresponding end of bracelet 3 only has to be mounted to the end of the stud opposite from the end comprising the slot 1.4.1 by inserting, for example, a screwed bar 3.2.1 in the drilling 1.4.2 and fixing bar 3.2.1 by a nut 3.2.2, as schematically illustrated in FIG. 1*c*. Alternatively, producing this attachment element 1.4 by a single piece substantially in T or H shape is possible, the leg of the T, respectively a side of the H forming the end of attachment element 1.4 comprising the slot or slots 1.4.1 and the cross of the T, respectively the other side of the H forming the opposite end comprising a recess adapted to receive a spring bar. These alternative embodiments are particularly well suited for attaching an interchangeable bracelet 3 in leather, rubber or in a synthetic material equipped with a conventional spring bar to a rapid attachment device 1 according to the present invention. Thus, the rapid attachment device 1 comprising a body 1.1 used as a push button, a retaining stem 1.2, a spring 1.3, and an attachment element or elements 1.4 as proposed forms a sturdy, sure and aesthetic connection that is easy to produce and use between the watch case 2 and the interchangeable bracelet 3, in addition to being rather flexible in its construction in order to be adaptable to several watch case shapes and, in particular, to several types of bracelets.

As briefly mentioned above, the present invention also relates to a corresponding watch case 2 for wrist watches, adapted to cooperate with a rapid attachment device 1 as described above. FIG. 1*c* shows that such a watch case 2 generally comprises a middle part 2.1, the two laterally opposed sides of which are arranged to receive an interchangeable watch bracelet. In particular, middle part 2.1 comprises, on each of the two opposed lateral sides, a housing 2.1.2 adapted to receive the body 1.1, the retaining stem 1.2, and the spring 1.3 of the rapid attachment device 1 and at least one recess 2.1.3 adapted to receive the attachment element or elements 1.4 of the rapid attachment device 1. The housing 2.1.2 adapted to receive the body 1.1, retaining stem 1.2 and spring 1.3 is situated parallel to the plane of the watch case 2 and has a generally elongated shape, the longitudinal axis of which is parallel to the longitudinal axis of a spring bar that conventional watch cases present. A first part of housing 2.1.2 supposed to receive body 1.1 is wider than a second part of housing 2.1.2 supposed to receive the retaining stem 1.2. This second part traverses the middle part 2.1 in its entirety and presents a shoulder forming a support for the terminal element 1.2.3 of the retaining stem 1.2, such that the attachment device 1 is, once assembled in housing 2.1.2 of middle 2.1, secured in this housing 2.1.2 while enabling movement in translation of body 1.1 following its activation by the user, as schematically illustrated in FIG. 1*e*. The exact shape of housing 2.1.2 may vary and obviously corresponds to the shape of body 1.1 and the retaining stem 1.2.

In addition, the middle part 2.1 of such a watch case 2 comprises at least one recess 2.1.3 adapted to receive the attachment element or elements 1.4, each recess 2.1.3 being substantially oriented perpendicularly with relation to housing 2.1.2 and opening onto the latter in order to give access to the mobile retaining stem 1.2. The position of recesses 2.1.3 is chosen so that each part of reduced thickness 1.2.1 of the retaining stem 1.2 appears, in the activation position of body 1.1, entirely in the corresponding recess 2.1.3, while, in the rest position a part of the retaining stem 1.2 presenting the reference thickness 1.2.2 appears in the corresponding recess 2.1.3. It is clear that the number of recesses 2.1.3 formed in the middle 2.1 depends on the desired number of attachment elements 1.4, respectively on the number of predefined locations of reduced thickness 1.2.1 on the retaining stem 1.2, which in its turn mainly depends on the desired design of the interchangeable bracelets 3 to be attached to this watch case 2. It is obvious that the above mentioned variations of parts 1.1, 1.2, 1.3, 1.4 forming the rapid attachment device 1 may be combined depending on and according to the specific constraints present in a specific case of a watch case 2 and an interchangeable bracelet 3.

Lastly, the present invention also relates to an interchangeable watch bracelet 3 arranged such as to be mounted on a rapid attachment device 1 as described above. As mentioned above, the bracelet may be made of various materials, for example of any type of metal, such as steel, gold, titanium or aluminium, of leather, of rubber, or else of a synthetic material, such as plastic, and the appearance of the interchangeable bracelet 3 may be chosen at will. In order to be adapted for any use in combination with a rapid attachment device 1 according to the present invention, the corresponding bracelet only has to present, as seen for example in FIGS. 1*c* and 1*e*, on its ends supposed to be attached to the watch chase 2, a suitable fastening means 3.2. The fastening means may be constituted for example of a screwed bar 3.2.1 comprising a nut 3.2.2, a spring bar, a screw or any other suitable means.

In view of the detailed description appearing above of the structure of a rapid attachment device 1 according to the present invention, or a corresponding watch case 2 and interchangeable bracelet 3, the operation of the device is easily understandable by using FIGS. 3*a* to 3*d* schematically illustrating, by side views and longitudinal sections, the two main states of operation of the device, i.e. when the device is in its rest position and its activation position.

Figure 3A:
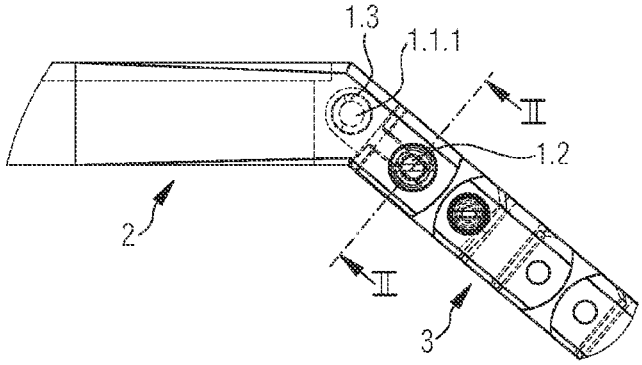
FIG. 3*a* schematically represents, by a side view, the rapid attachment device according to an embodiment of the present invention, respectively the corresponding watch case and interchangeable watch bracelet, in their assembled state, when the rapid attachment device is in its rest position, some parts being illustrated in transparency for better comprehension.
Figure 3B:
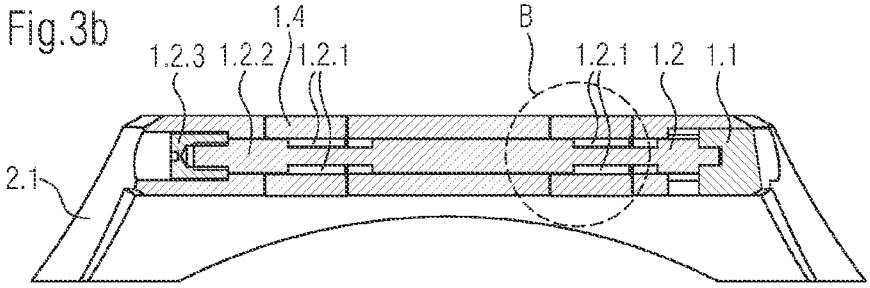
FIG. 3*b* is a longitudinal section along line II-II indicated in FIG. 3*a* across the rapid attachment device according to the present invention.

FIG. 3*a* shows a side view of the rapid attachment device 1 according to the present invention, respectively of the corresponding watch case 2 and of the interchangeable watch bracelet 3, in their assembled states, when the rapid attachment device 1, particularly the body 1.1 used as a push button, is in its rest position, and FIG. 3*b* is a longitudinal section along line II-II indicated in FIG. 3*a* across the rapid attachment device 1. These figures show, in particular on zone B of FIG. 3*b*, that flats 1.2.1.1, respectively in general the parts of the retaining stem 1.2 presenting a reduced thickness 1.2.1, are at least partially offset from the slots 1.4.1 arranged on the attachment elements 1.4 when the body 1.1 used as a push button is in its rest position. The interchangeable bracelet 3 is therefore rigidly connected to the watch case 2 through the rapid attachment device 1, while having a certain freedom of articulation around the longitudinal axis of the retaining stem 1.2.

Figure 3C:
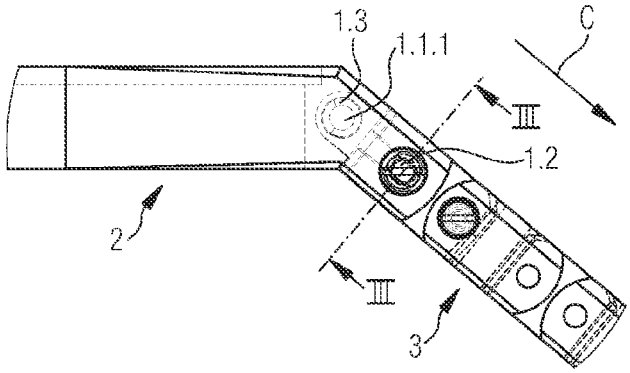
FIG. 3*c* represents, by a side view similar to FIG. 3*a*, the rapid attachment device according to an embodiment of the present invention, respectively the corresponding watch case and interchangeable watch bracelet, when the rapid attachment device is in its activation position, some parts being illustrated in transparency for better comprehension.
Figure 3D:
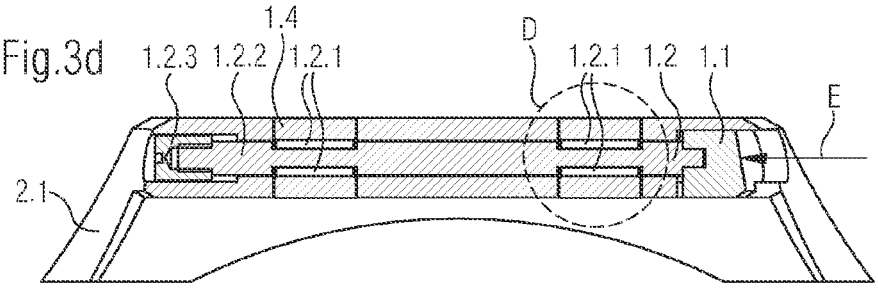
FIG. 3*d* depicts a longitudinal section along line III-III indicated in FIG. 3*c* across the rapid attachment device.

FIG. 3*c* represents a side view similar to FIG. 3*a* of the rapid attachment device 1, respectively of the corresponding watch case 2 and of the interchangeable watch bracelet 3, when the rapid attachment device, particularly body 1.1 used as a push button, is in its activation position. FIG. 3*d* shows a longitudinal section along line III-III indicated in FIG. 3*c* across the rapid attachment device 1, spring 1.3, not visible in this figure, being compressed following activation of body 1.1 by the user, thus shifting the retaining stem 1.2 to the inside of the housing 2.1.2 of the middle part 2.1. In this position, when body 1.1 used as a push button is activated, the flats 1.2.1.1, respectively in general the parts of retaining stem 1.2 presenting a reduced thickness 1.2.1, are aligned with the slots 1.4.1 of said attachment elements 1.4, as seen in particular in zone D of FIG. 3*d*. In this figure, arrow E indicates that body 1.1 is activated.

In the preferred embodiment illustrated in the figures, the user may then orientate the interchangeable bracelet 3 in said specific orientation mentioned above, i.e. in a direction such that the direction perpendicular to the plane of the guiding flats 1.2.1.1 is found substantially aligned to the normal on the plane of slot 1.4.1 of attachment elements 1.4, to release the interchangeable bracelet 3 and therefore enable the interchangeable bracelet 3 to be removed from rapid attachment device 1, respectively from the watch case 2, as well as attach the same, or another, interchangeable bracelet 3 of his choice to the watch case 2. During fabrication, the retaining stem 1.2 may be mounted on body 1.1, by using the above mentioned first 1.1.3 and second 1.2.1.2 indexing flats situated on body 1.1 respectively said end of stem 1.2, by having an orientation such that the guiding flats 1.2.1.1 present the required orientation with relation to slot 1.4.1 of attachment elements 1.4 in a predefined position of bracelet 3 with relation to the watch case 2, given that it is this position which is visible to the user. As indicated symbolically by arrow C in FIG. 3*c*, it is preferable that in this required orientation of the bracelet enabling its removal or its attachment, the longitudinal axis of the bracelet is parallel to one part of the watch case, for example parallel to the upper surface of the lateral part of the middle part 2.1 integrating body 1.1. The designer may thus choose the level of additional security against any inadvertent removal of the bracelet 3 by correspondingly adapting the angle of orientation between the interchangeable bracelet 3 and the watch case 2 that enables removal and attachment of the bracelet 3. This measure reinforces the measures mentioned before foreseen at the level of the force of the biasing spring 1.3 as well as by integrating the body 1.1 used as a push button in the middle part 2.1 by aligning the external surfaces 1.1.2, 2.1.1 of body 1.1 and middle part 2.1. Consequently, a disengagement of the interchangeable bracelet 3 is only produced upon pressure on the body 1.1 by the user while the latter orientates the bracelet 3 to a predefined angle with relation to the watch case 2, whereas an involuntary or accidental disengagement of bracelet 3 from watch case 2 can be practically ruled out due to the fact that the spring 1.3 biases and maintains body 1.1 or retaining stem 1.2 mobile in their rest position, that an inadvertent activation of body 1.1 integrated in the middle part 2.1 is unlikely, and that a specific orientation of bracelet 3 with relation to the watch case 2 is necessary for its disengagement, at least in the preferred embodiment of the device. In other less-preferred embodiments of the device, comprising for example a cylindrical retaining stem 1.2 with two different diameters, it is not necessary to orientate the bracelet specifically to remove or attach the bracelet.

While having a sturdy structure and being compact and relatively simple as compared to prior art, the rapid attachment device according to the present invention may include numerous variations. Due to the simple structure of the device as well as the small volume occupied compared to similar devices from the prior art, the device is rather easy to produce industrially, enabling the production costs of such a rapid attachment device, respectively of a watch equipped with such a device, to be reduced. In addition, the device enables a simple, sure and reliable utilization. In fact, it is clear that a rapid attachment device comprising the characteristics mentioned above is simply activated by pressure, optionally by orientating the interchangeable bracelet in a specific direction, in order to enable the bracelet to be removed, respectively to be attached, while an inadvertent activation of the push button, respectively an involuntary or accidental removal of the interchangeable bracelet, can be practically ruled out. The guiding of the movement in translation by the body forming the push button and the pin as well as the stem attached thereto and the absence of complex kinematics makes the operation of the device reliable. The device presents the important advantage that it is easier to integrate in existing timepieces than systems from the prior art, without requiring too many adjustments or an important revision in the design of these pieces. In summary, the rapid attachment device according to the present invention enables the user to change, according to his taste and/or considering the conditions of use of his watch, the interchangeable bracelet attached to the watch case, intuitively and without needing a tool or any special skills.

The invention claimed is:

1. A rapid attachment device of an interchangeable watch bracelet for wrist watches, the device comprising a body used as a push button and being adapted to be housed slidingly in a watch case, the body bearing a retaining stem arranged parallel to the plane of the watch case and in the direction of sliding of said body, such that the body is displaceable parallel to a longitudinal axis of said retaining stem, wherein the body cooperates with a spring arranged substantially parallel to said retaining stem and exerting as pretension force biasing the body used as a push button in a rest position, said retaining stem having a particular shape having in at least one predefined location along its longitudinal axis a reduced thickness in relationship to a reference thickness that presents the rest of the retaining stem the device comprising at least one attachment element adapted to be mounted at one end of said interchangeable watch bracelet and comprising a slot of a shape complementary to that of the retaining stem, the latter being adapted, depending on its position along said longitudinal axis, to cooperate with the attachment element or elements so as to allow said interchangeable watch bracelet to be attached to or to be removed from the watch case.

2. The device according to claim 1, wherein said retaining stem comprises guiding flats in at least one predefined location, preferably in two predefined locations, such that the guiding flats are aligned with the slots of said attachment elements when the body used as a push button is activated and such that the guiding flats are at least partially offset from these slots when the body used as a push button is in its rest position.

3. The device according to claim 1, wherein said retaining stem comprises a terminal element mounted on a free end, opposite to its end fixed to the body used as a push button, and enabling the body to be secured against any detachment from the watch case.

4. The device according to claim 1, wherein said spring arranged substantially parallel to said retaining stem is fixed to a free end of a pin mounted on the body used as a push button and arranged parallel to said retaining stem.

5. The device according to claim 1, wherein said spring arranged substantially parallel to said retaining stem is a helical spring.

6. The device according to claim 1, wherein the slot of complementary shape on each attachment element is formed by a channel with a height corresponding to the reduced thickness of said retaining stem, this channel being adapted to allow said retaining stem, in the activated position of said body used as a push button, to pass through and opening to a through housing with a diameter corresponding to the reference thickness of said retaining stem, this through housing being adapted to receive said retaining stem in the rest position of said body used as a push button.

7. The device according to claim 1, wherein each attachment element is arranged so as to receive a fastener of a watch bracelet, this fastener being mounted on the end of the attachment element opposite to its end comprising said slot.

8. The device according to claim 7, wherein the fastening means is chosen from the group of fastening elements comprising a screwed bar, a spring bar, a screw.

9. The device according to claim 1, wherein the attachment element is made of a substantially rectangular parallelepiped stud adapted to receive on its end, opposite from the end comprising a slot, a screwed bar.

10. The device according to claim 1, wherein the attachment element is made by a single piece substantially in a T shape, the leg of the T forming the end of attachment element comprising the slot and the cross of the T forming the opposite end comprising a recess adapted to receive a spring bar.

11. The device according to claim 1, wherein said body used as a push button is arranged so as to present, in its rest position, an external surface that is aligned and homogeneous with relation to the external surface of the watch case in which it is supposed to be integrated.

12. A watch case for wrist watches comprising a middle part, the two opposed lateral sides of which are arranged to receive an interchangeable watch bracelet, wherein the middle part comprises, on each of said two opposed lateral sides, a housing adapted to receive the body, the retaining stem, and the spring of a rapid attachment device according to claim 1 and at least one recess adapted to receive the attachment element or elements of said rapid attachment device.

13. The watch case according to claim 12, wherein said housing adapted to receive the body, the retaining stem and the spring are oriented substantially perpendicularly with relation to the recesses adapted to receive the attachment element or elements.

14. An interchangeable watch bracelet, wherein it is arranged so as to be mounted onto a rapid attachment device according to claim 1.

15. The watch bracelet according to claim 14, wherein it is fabricated in a material chosen from the group comprising metals, such as steel, gold, titanium or aluminium, leather, rubber, synthetic materials, such as plastic.

* * * * *